United States Patent [19]

Bonilla-Lugo et al.

[11] 4,454,702

[45] Jun. 19, 1984

[54] BUILDING CONSTRUCTION AND METHOD OF CONSTRUCTING SAME

[76] Inventors: Juan Bonilla-Lugo; Felix A. Rodriguez-Molinary, both of Avenue Hostos No. 103, Ponce, P.R.

[21] Appl. No.: 325,398

[22] Filed: Nov. 27, 1981

Related U.S. Application Data

[63] Continuation-in-part of Ser. No. 246,969, Mar. 24, 1981, which is a continuation of Ser. No. 960,414, Feb. 8, 1979, abandoned.

[51] Int. Cl.[3] ..... E04C 2/26; E04G 21/00

[52] U.S. Cl. ..... 52/745; 52/251; 52/309.12; 52/295; 52/405

[58] Field of Search ..... 52/381, 383, 309.12, 52/405, 741, 745, 747, 251

[56] References Cited

U.S. PATENT DOCUMENTS

| | | | |
|---|---|---|---|
| 1,875,131 | 8/1932 | Pentland | 52/383 |
| 2,192,183 | 3/1940 | Deutsch | 52/381 |
| 2,262,899 | 11/1941 | Mechlin | 52/741 |
| 2,718,138 | 9/1955 | Jones | 52/405 |
| 3,295,278 | 1/1967 | Muhn | 52/309.12 |
| 3,438,161 | 4/1969 | Koch | 52/309.12 |
| 3,879,908 | 4/1975 | Weismann | 52/577 |
| 4,025,981 | 11/1978 | MacLeod | 52/741 |

*Primary Examiner*—John E. Murtagh

*Attorney, Agent, or Firm*—Sprung, Horn, Kramer & Woods

[57] ABSTRACT

A building construction comprising a concrete footing in situ having a plurality of metal members extending outwardly therefrom. At least one module for each wall and each ceiling of the construction is formed by bending an open wire mesh in a substantially U-shaped configuration and closing the open end thereof with a joist. At least one core is disposed within each module and the one is maintained in place with wire ties connected to the mesh and extending through the core and spacing blocks between the core and mesh. Each joist is connected to at least one projecting metal member and the modules are connected by interconnecting the joists thereof. A layer of concrete is formed around the mesh and completely surrounding the core and joists.

5 Claims, 18 Drawing Figures

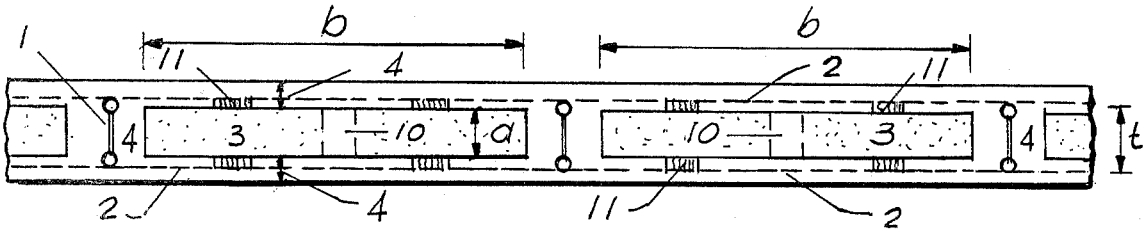
FIG. 3-a
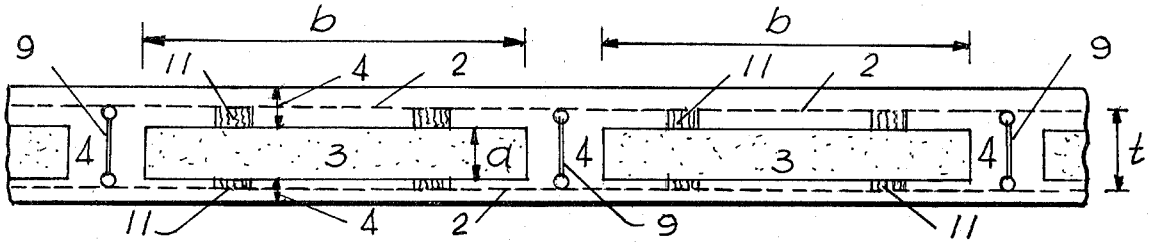
FIG. 3-b
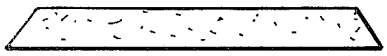
FIG. 4-a
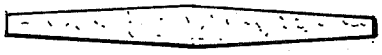
FIG. 4-b
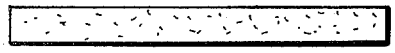
FIG. 4-c
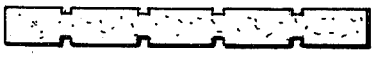
FIG. 4-d
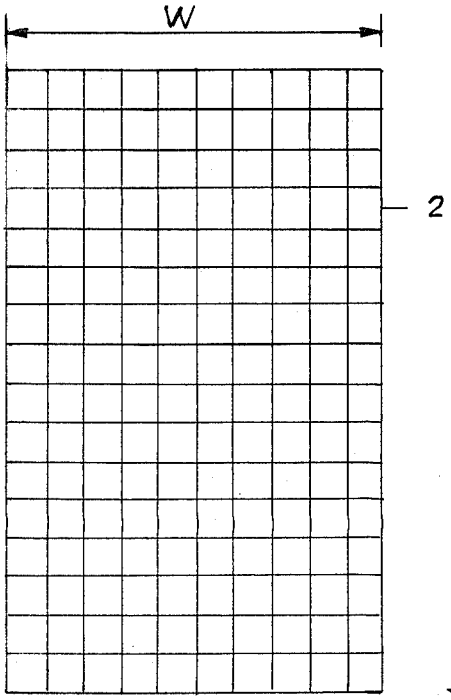
FIG. 5-a
FIG. 5-b
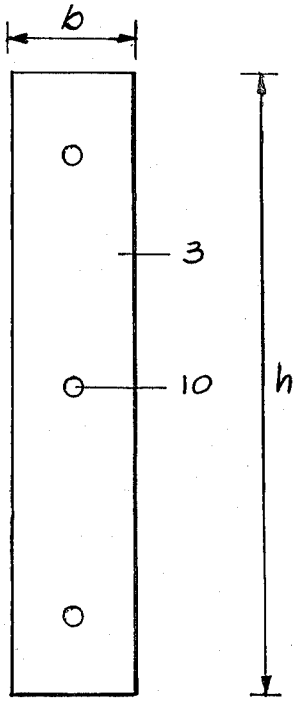
FIG. 6-a
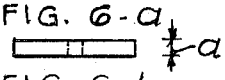
FIG. 6-b
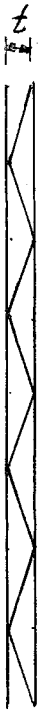
FIG. 7-a
FIG. 7-b

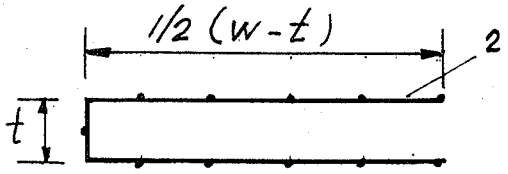
FIG. 8 (STEP NO. 1)
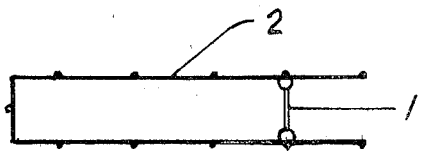
FIG. 9 (STEP NO. 2)
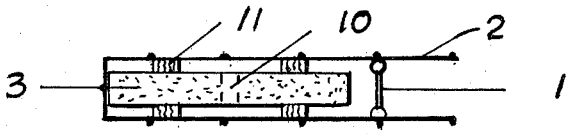
FIG. 10 (STEP NO. 3)
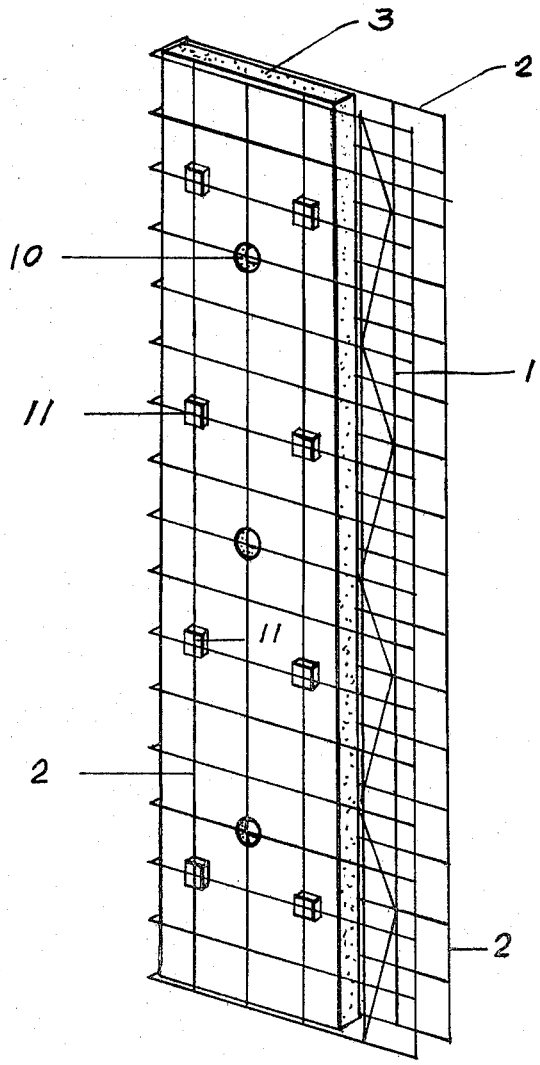
FIG. 11

BUILDING CONSTRUCTION AND METHOD OF CONSTRUCTING SAME

This application is a continuation-in-part application of application Ser. No. 246,969 filed Mar. 24, 1981, which is a continuation of application Ser. No. 960,414 filed Feb. 8, 1979 and now abandoned.

BACKGROUND OF THE INVENTION

The present invention relates to a building construction and a method of constructing same and more specifically one wherein the building has walls and ceilings incorporating insulating elements and reinforcing structural members without the need for providing molds therefor.

It is known in the art to provide prefabricated building modules for a building construction, however the known prefabricated modules use concrete sprayed onto the previously built structure and these units therefore have the disadvantage that they are difficult to transport from the factory to the job site with a high probability of cracking or breaking. Moreover, these units do not lend themselves to being continuous in nature when erected and when they are prefabricated, they reduce the ability to incorporate other building elements into the walls at the job site when necessary.

SUMMARY OF THE INVENTION

It is therefore an object of the present invention to provide a building construction and method of constructing same wherein insulation may be incorporated as part of the system, cracks in concrete can be eliminated due to transportation, and the structural members that result are continuous to provide a stronger and lighter structure than is conventionally available.

In accordance with the present invention, these objects are achieved by the building construction and method of constructing same comprising providing a concrete footing in situ having a plurality of metal members extending outwardly therefrom, providing at least one module for each wall and each ceiling of the building to be constructed from a mesh and a joister, disposing at least one core within each module and connecting each wall module to at least one of ceiling frame and a projecting metal member to define a self-supporting building frame without the need of first providing a superstructure and applying wet concrete around the modules to completely surround the core and the metal joist and allowing same to cure.

The advantages of such a system, as is disclosed herein, is that there is a considerable reduction in cost of construction due principally to the reduction in labor costs, elimination of casting molds and also to a more economical use of materials. The construction of the building is faster than conventionally accomplished and the resulting building results in a reinforced concrete shell having insulating core in at least the walls and ceiling and preferably the floors thereof. The resulting structure is lighter than is conventionally available, and there is a savings in the method of constructing the building because molds, studs, heavy equipment and other similar units are not needed.

The mesh which is incorporated in the concrete facings eliminates the possibility of cracks in the concrete and the frame which acts to hold the insulation core in place, also provides reinforcement for the concrete.

The joists are preferably metal and include vertical members connected together by horizontal members or other equivalent reinforcement therefor. This results in beams, columns, ceilings and other load bearing walls being stronger structural elements.

The method enables one to have improved control of production due to fewer variables in the construction process and there is an ease of installation of electrical and plumbing facilities due to the fact that the concrete is applied in situ. In the preferred embodiment, prefabricated modules including the metal frame, the core inside, and the mesh outside can be prefabricated as modules at the factory and transported as such, wherein the prefabricated modules are then connected to metal members in the footings and thereafter the wet concrete is applied therearound.

When these prefabricated modules are utilized, about 50% of electrical and plumbing facilities can be inserted therein before transporting same to the job site.

The method and structure of the present invention also has the advantage that there is no inherent limitation as to the size or type of building to be produced and may include any shape of wall or ceiling elements.

The ceiling can be preferably joined to the wall units by welding or otherwise mechanically connecting the ceiling frames to the wall frames and as a result greater strength and faster installation results.

The method of the present invention lends itself to mass production and semi- or fully automatic processes of fabrication especially in view of the modular construction away from the building site.

Moreover, the method has the advantage that the structure is self-supporting prior to the application of the concrete without the need for first constructing a superstructure or beam frame.

In a preferred embodiment the module is constructed from a steel wire mesh bent into a U-shape and closed at its open end by a steel joist. An insulating core, preferably polystyrene foam, is inserted within the module enclosure and held in place by ties.

The invention will now be described with preferred embodiments thereof as shown in the accompanying drawings by way of example wherein:

BRIEF DESCRIPTION OF THE DRAWINGS

FIGS. 3*a* and 3*b* are sectional views taken along line IIIA—IIIA and IIIB—IIIB, respectively, in FIG. 1;

FIGS. 4 *a–d* are sectional views of alternative embodiments of the core according to the invention;

FIGS. 5*a* and 5*d* are front and side views of the wire mesh used in the invention;

FIGS. 6*a* and 6*b* are front and side views of a core used in the invention;

FIGS. 7*a* and 7*b* are front and side views of joists used in the present invention;

FIGS. 8–10 illustrate method steps according to the present invention using the elements of FIGS. 5–7; and FIG. 11 shows a plane view of the structure resulting from the steps of FIGS. 8–10; and

DETAILED DESCRIPTION OF THE PREFERRED EMBODIMENTS

Figure 1:
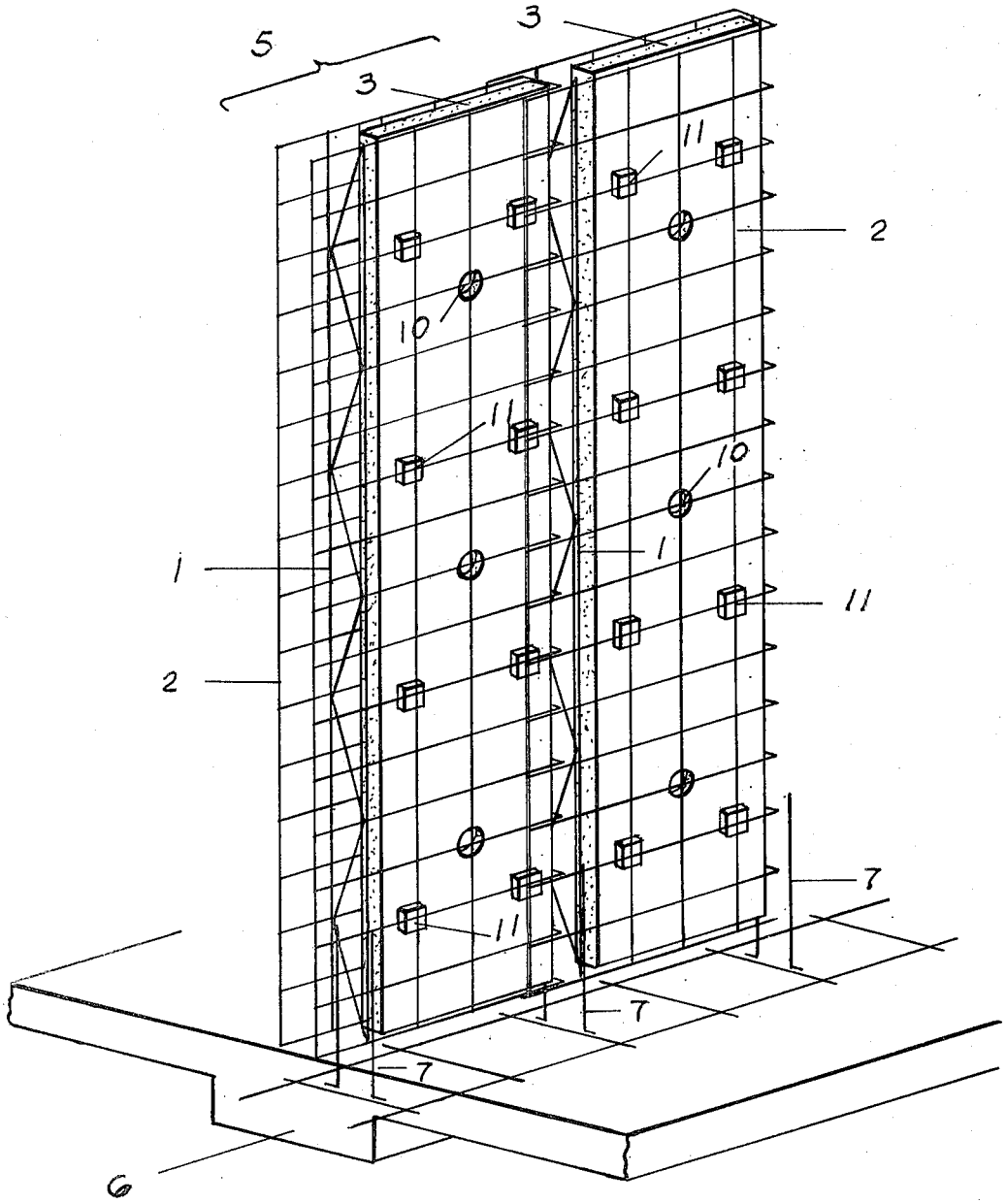
FIG. 1 is a partially cutaway perspective view of one embodiment according to the present invention.
Figure 2:
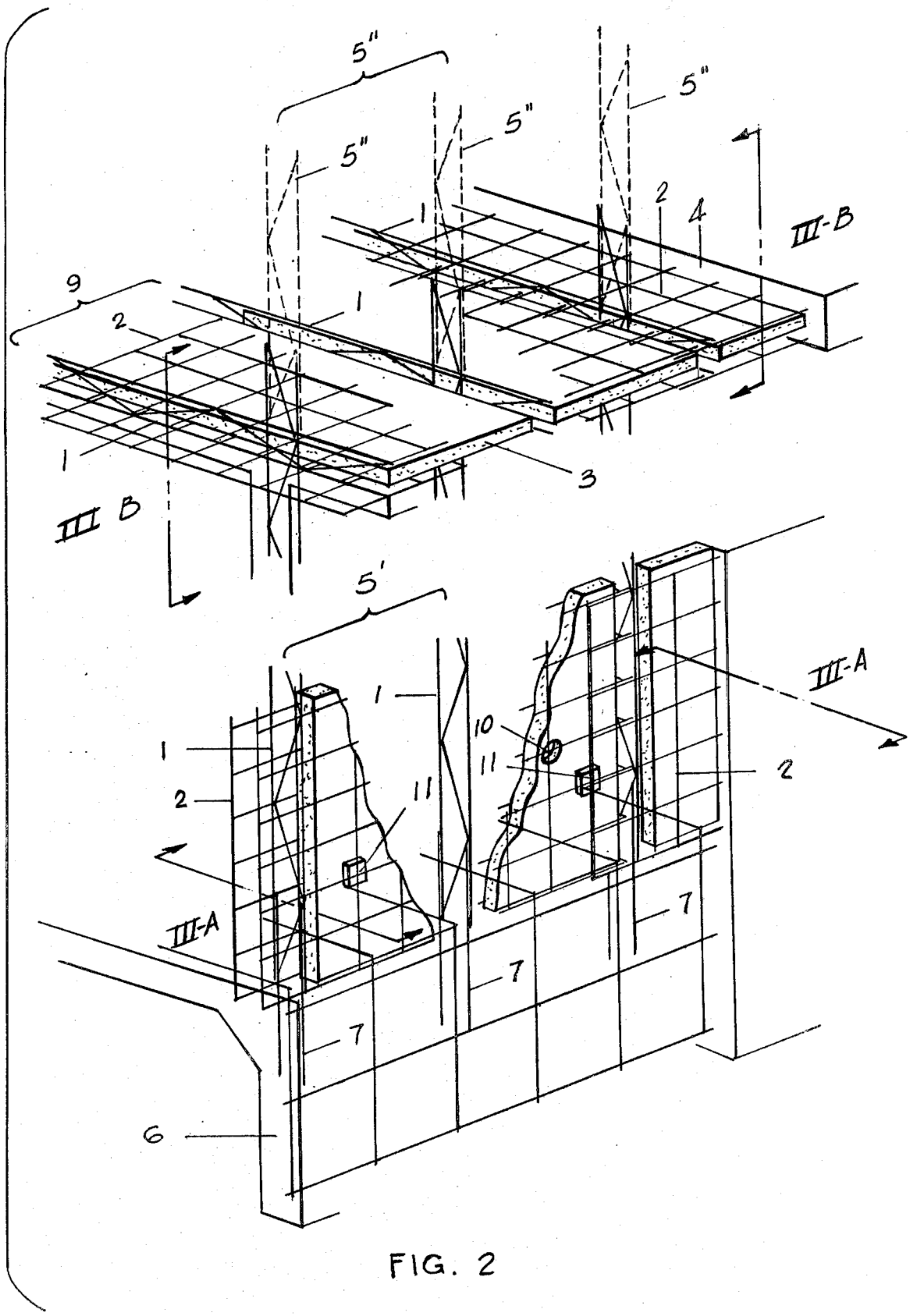
FIG. 2 is a partially cutaway perspective view of another portion of the structure as shown in FIG. 1.

Referring now to FIGS. 1 and 2, the structure of the present invention includes footings 6 which are constructed in a conventional manner out of concrete and determined by the design of the building. Preferably, and in accordance with the present invention, a steel frame is disposed on the footings when poured to provide reinforcement therefor and includes a plurality of members 7 extending outwardly from the footings. The footings serve as the floor of the building.

The building structure includes at least one module 5 corresponding to the walls of the building. The wall may have a single module or a series of two (as shown) or more modules. The module 5 in FIG. 1 corresponds to an interior wall while the module 5' in FIG. 2 corresponds to an exterior wall of the structure. The modules 5,5' are connected at the bottom of joists 1 to members 7 by welding or otherwise mechanically connecting same.

Each module as shown is composed of steel mesh 2 or equivalent material and a single vertical joist 1. The modules may also be located where columns or other structural and non-load bearing elements are required by the design of the building.

Each ceiling or roof of the building is thereafter constructed with at least one ceiling module 9 which is constructed similarly to that of wall module 5 and includes joists 1 and mesh 2 and are welded or otherwise mechanically connected at the joists thereof to the joists of the wall modules 5,5' which applicable as shown in FIG. 2. Additionally, where a second or additional story is required, a wall modules 5" are connected at the joists thereof to the joists of the corresponding upper and lower ceiling module 9.

In one embodiment, before modules 5,5' are put into place, cores 3 of insulating foam such as polystyrene foam or equivalent material are inserted within the same serving as a spacing member and, is required, as insulation. The wire mesh 2 forms an outer skin, optionally holds the foam material in place and serves as a base on which to apply concrete. The ceiling modules are similarly constructed.

The resulting frame structure comprising the interconnected joists with the foam and mesh is self-supporting before the concrete is applied and is designed to support the weight of the concrete before it sets or cures, thus eliminating the need of other supporting structures during construction.

In the preferred embodiment the modules are prefabricated at the factory and brought to the site and thereafter welded together in the manner described above.

At the point before concrete is applied to the structure, door and window frames and other frames or guides may be placed on the structure at this time. Electrical tubing and plumbing may also be installed at this point.

Thereafter, concrete 4 is sprayed or applied by hand onto the structure shown in FIGS. 1 and 2 to completely surround the cores the metal joist and the mesh and is held onto the walls and ceilings by the mesh. The concrete 4 fills the spaces around the cores 3 and surrounds the joists resulting in a structure in which reinforced concrete walls, columns, beams and ceilings alternate with regions where insulating or spacing cores are sandwiched between concrete faces. This structure is shown in FIGS. 3*a* and 3*b*.

In order to make the structure stronger, throughbores 10 may be provided in the cores and into which concrete is received to thereby connect opposite facings of the concrete shell 4 surrounding the cores 3. When the bores 10 are filled with concrete a plug is formed which connects opposite surfaces of the concrete shell 4. Furthermore, a wire tie, may be placed in the bore to further reinforce the plug and to serve as separators to the wire mesh on both sides.

In a preferred embodiment, concrete is applied first to the interior walls and bottom of the ceiling modules to increase the rigidity of the roof structure, prevent leakage of concrete through the openings of the structural members, to prevent the leakage of the concrete mix water through mold joints of other conventional construction systems reducing the concrete strength and to prevent the dehydration of the concrete that should be applied on top in the next application. Additionally, this forms an integral inner concrete unit which adds strength to the structure. The simultaneous application of concrete to inside walls and the bottom of the roof eliminates cold joints between the roof and the walls. Thereafter, the top of the ceiling and the exterior walls can have the concrete applied thereto to finish the building structure. As shown in FIG. 3*b*, this results in a thinner concrete face on the bottom of the ceiling while the top thereof will be thicker to enable it to be used as a floor for the next story or as a roof slab.

Wall finishing can be done simultaneously with the spraying of concrete onto the structure since plastering is avoided because the concrete can be smoothed while it is wet.

After the concrete cures and sets, the building is ready for the installation of doors, windows, plumbing fixtures, cabinets, etc. This can be done in a conventional manner and a further finishing of the walls and roof slabs is done in a conventional manner.

As has been started previously, in the preferred embodiment, the wall and ceiling structural modules without the concrete but with the insulation cores are assembled at a factory away from the building site and may be therefore mass produced. The application of concrete is done in situ by semi automatic concrete spraying machines.

In a further embodiment of the basis system of the present invention, the polystyrene or equivalent cores can be replaced by removable interior separators or molds which can be removed after the concrete hardens to leave a hollow space in the wall or slab. FIGS. 4*a* and *b* show the cores can have different shapes as desired, while FIG. 4*c* shows a core having a mixture of foam in a cementitious block. FIG. 4*d* illustrates the embodiment wherein an open space is utilized between the concrete faces and FIG. 4*e* shows an alternative embodiment wherein the core has a plurality of grooves or channels encircling same and which will be filled in with concrete.

EXAMPLE

A. Fabrication:

The steel-wire module with insulation core that comprises the walls and roof structural sections of the system of construction is fabricated in a standard size and form for the ordinary construction of one or two story dwellings.

The standard module is fabricated in the following manner:

1. A 5'-0" wide wire mesh sheet 2 illustrated in FIGS. 5*a* and 5*b* is cut to a height "h" and bent in step 1 as illustrated in FIG. 8.

2. The prefabricated open-web steel joist 1 shown in FIGS. 7*a* and 7*b* is inserted in the position in step 2 illustrated in FIG. 9 using wire ties to fasten the joist to the wire mesh. The wire ties are located at the cross-wires intersections to assure the correct and stable position of the joist in a permanent and fix way.

3. The rigid insulation core 3 shown in FIGS. 6*a* and 6*b* is pushed through the enclosed space formed by the wire mesh and the steel joist. The insulation core is fastened in place and fixed in the right position in step 3 illustrated in FIG. 10 by the use of concrete blocks separators 11 tied in place by wire ties. Additional wire ties are inserted through the boreholes 10 and fastened to the wire mesh on both faces of the module as shown in FIG. 11. Height "h" is the ceiling height in the case of wall sections and the span length between supporting load bearing walls in the case of roof sections. The thickness "t" and the size of the insulation board "a" and "b" depends on whether the framed section module is to be used as a wall or roof section.

For wall sections: See FIG. 3-*a* t=3", a=2" and b=20".

The concrete blocks separators size is 2"×2"×½".

For Roof sections: See FIG. 3-*b* t=4", a=3" and b=20".

The concrete blocks separators size is 2"×2"×1" on top and 2"×2"×½" under ceilings.

The steel-wire module with insulation core fabricated as explained herein is very simple, practical, light in weight and inexpensive. It weighs 1 lb/sq.ft. and because its light weight it is easy to handle, easy to install and easy to transport from one place to another.

B. Installation:

During the installation process the steel joist is welded to dowels projecting from a conventionally constructed concrete floor slab or foundation walls, fixing the wall section module in the upright, plumb and in the proper aligned position.

The standard modules are inserted one into the other through its male and female ends and clipped together to form the wall structure with adequate wire overlapping to provide extra rigidity. The U-shaped bending of the wire mesh sheets with the steel joist fastened to the other end provides a very rigid steel-wire section requiring no bracing during the installation stage to keep its upright position.

Steel angles are welded connecting all the joists at their upper ends to provide the proper alignment and plumb position of all the wall frame modules installed. These angles also provide a better bearing surface for positioning and resting the roof slab steel joist for further welding to wall frames.

Roof section modules are installed over the wall section modules by welding the wall section steel joists to the roof section steel joist to form a steel framed structure. This steel framed structure occurs every 2'-0" all throughout the load bearing walls supporting the roof structure. This steel framed structure erected as indicated has the adequate strength to support the dead and live loads imposed on the structure by workmen during the installation process.

C. Concrete Application:

Concrete is pneumatically applied to both faces of the wall structure, completely embedding the steel joists and the insulation board to complete the steel reinforced concrete structure.

In the roof slab structure, the concrete is applied under the ceiling first, so that upon hardening it produces an impermeable leak-proof form that serves to pour the concrete on the roof or floor slab above. In that way, water leakage that weakens the concrete and affects adversely the proper curing due to the loss of water of the concrete while in the process of hardening is avoided.

The application of the concrete to the ceiling surface eliminates the need of forms otherwise needed to cast the roof and floor slabs.

The reinforced concrete, insulated structure constructed as explained herein comprises two important structural members:

1. A steel reinforced, insulated, lighter loadbearing concrete shear wall with adequate strength to support the dead and live loads from concrete roof or floor slabs built above and the required strength to resist the lateral loads produced by hurricane winds and earthquake loads acting on a concrete structure.

2. A steel reinforced, insulated, lighter concrete roof slab with adequate strength to support the dead and live loads of concrete roof or floor slabs required by the building codes.

It will be appreciated that the instant specification and embodiments are set forth by way of illustration and not limitation and that various modifications and changes may be made without departing from the spirit and scope of the present invention. It is clear that within the scope of the invention, one may spray a mixture of concrete and glass fiber to further reinforce the concrete shell around the core and that the modules do not have to be vertical and horizontal as shown but may take any desired configuration as is called for by the architectural plans for a building.

What is claimed is:

1. A method of constructing a building comprising a. providing a concrete footing in situ having a plurality of metal members extending outwardly therefrom;

b. providing at least one module for each wall and each ceiling of the building to be constructed by bending an open wire mesh in a substantially U-shaped configuration and closing the open end thereof with a joist;

c. disposing at least one core within each module and maintaining the core in place with wire rig ties connected to the mesh and extending through the core bore hole and placing spacing blocks between the core and mesh;

d. installing each wall module by connecting the joist of each wall module to at least one of the metal member projecting outward from the footing and interconnecting the module joists of the wall and ceiling modules to define a self-supporting building frame; and e. applying wet concrete around the mesh and completely surrounding the core and the joists and allowing same to cure.

2. The method according to claim 1, wherein modules are prefabricated in standard sizes according to steps (b)-(c) and the modules are mechanically connected as a unit in step (d).

3. The method according to claim 1, wherein the cores are provided with throughbores therein and wherein concrete is applied to the throughbores in step (c) to connect the concrete facings to increase the strength thereof.

4. A method according to claim 1, wherein the concrete is applied to the inner walls and bottom surface of the ceiling prior to the curing of either one thereof to make same integral therewith and provide the forms, once the bottom surface of the ceiling hardens, for the application of the ceiling.

5. A method according to claim 1, wherein the concrete is applied to the outer wall surface to complete the wall structure and over the hardened ceiling to complete the reinforced ceiling structure.

* * * * *